US006270328B1

(12) United States Patent
Herbert et al.

(10) Patent No.: US 6,270,328 B1
(45) Date of Patent: Aug. 7, 2001

(54) INTERLOCKING SCROLL COMPRESSOR COMPONENTS

(75) Inventors: Jay Andrew Herbert; Paul Murphy, both of Arkadelphia, AR (US); John R. Williams; Tracy Milliff, both of Bristol, VA (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/534,792

(22) Filed: Mar. 24, 2000

(51) Int. Cl.[7] ..... F04C 18/04
(52) U.S. Cl. ..... 418/55.1
(58) Field of Search ..... 418/55.1; 29/888.022

(56) References Cited

U.S. PATENT DOCUMENTS 5,445,507 * 8/1995 Nakamura et al. ..... 418/55.1
5,551,851 * 9/1996 Williams et al. ..... 418/55.1
6,027,321 * 2/2000 Shim et al. ..... 418/55.1

* cited by examiner

*Primary Examiner*—John J. Vrablik
(74) *Attorney, Agent, or Firm*—Carlson, Gaskey & Olds

(57) ABSTRACT

A non-orbiting scroll has structure which interfits with the crankcase towers. The crankcase towers are circumferentially spaced by gaps, and the non-orbiting scroll has tabs which extend into those gaps. The crankcase towers preferably fit into grooves in the non-orbiting scroll. The crankcase towers and the grooves on the non-orbiting scroll properly position the non-orbiting scroll and the crankcase relative to each other. The tabs extending into the gaps between the crankcase towers prevent the ingress of welding material into the compressor housing.

13 Claims, 3 Drawing Sheets

INTERLOCKING SCROLL COMPRESSOR COMPONENTS

BACKGROUND OF THE INVENTION

This invention relates to a scroll compressor wherein the crankcase and the non-orbiting scroll are interconnected in a way that reduces assembly difficulties, and further reduces the possibility of weld spatter.

Scroll compressors are becoming increasingly popular for refrigerant compression applications. In a standard scroll compressor, a first scroll member is formed with a base and a generally spiral wrap extending from the base. A second scroll member has a base and a generally spiral wrap interfitting with the wrap of the first scroll member. The second scroll member is caused to orbit relative to the first scroll member and compression chambers defined between the two scroll members are reduced in volume to compress an entrapped refrigerant.

A crankcase supports the second scroll member, and sits on an opposed side of the second scroll member from the first scroll member. In some applications, the first scroll member is fixed relative to the crankcase. In other scroll compressors the first scroll member is allowed to move axially, but is prevented from orbiting or rotating. The crankcase is typically positioned relative to the first scroll member by dowel pins, or other structure extending between the two members. Alternatively, automated assembly and measurement equipment have been utilized to properly position the two components. These approaches have been somewhat complex and undesirable.

The standard crankcase includes a plurality of circumferentially spaced crankcase towers. These are structures extending axially beyond the second scroll member, which typically extend to be in close relationship with the first scroll member.

Scroll compressors are received in a sealed housing chamber. The housing chamber are formed of a central cylindrical shell which is welded to an end cap by a girth weld. The circumferentially spaced towers on the crankcase block the ingress of weld material, known as weld spatter, from moving between the end cap and the center shell into the housing chamber. However, the ingress of welding material does occur in the gaps between the crankcase towers.

The crankcase towers have a structural and casting function, and thus it would not be desirable to simply eliminate the crankcase towers, or to form them around the entire circumference of the crankcase.

The present invention is directed to eliminating the above-discussed challenges for scroll compressors.

SUMMARY OF THE INVENTION

In the disclosed embodiment of this invention, tabs are formed on the first scroll member at circumferentially spaced locations. The tabs are aligned with the spaces between the crankcase towers and move into those spaces when the scroll compressor is assembled. The tabs extend downwardly for a sufficient distance to block the ingress of weld material between the center shell and the end cap at the circumferential locations between the crankcase towers. Thus, the tabs eliminate the weld spatter problem.

In another feature of this invention, the tabs on the first scroll are spaced by grooves. The grooves are aligned with the crankcase towers. At least one of the grooves is formed such that the circumferential edge to edge distance of the groove provides a very close tolerance, or even a light interference fit with one of the corresponding crankcase towers. In this way, the groove to crankcase tower interconnection provides tight rotational positioning tolerance between the crankcase and the non-orbiting scroll.

In further features of this invention, the groove has its inner periphery cut at a close radius to match the inner periphery of the crankcase tower. In this way, positioning the crankcase towers in the circumferentially spaced grooves serves to position the non-orbiting scroll and the crankcase at a desired relative location in a plane perpendicular to the axis of movement of the orbiting scroll.

Thus, the use of tabs extending between the crankcase towers, with corresponding grooves aligned with the crankcase towers provides valuable benefits. These and other features of the present invention can be best understood from the following specification and drawings, the following of which is a brief description.

DETAILED DESCRIPTION OF A PREFERRED EMBODIMENT

Figure 1:
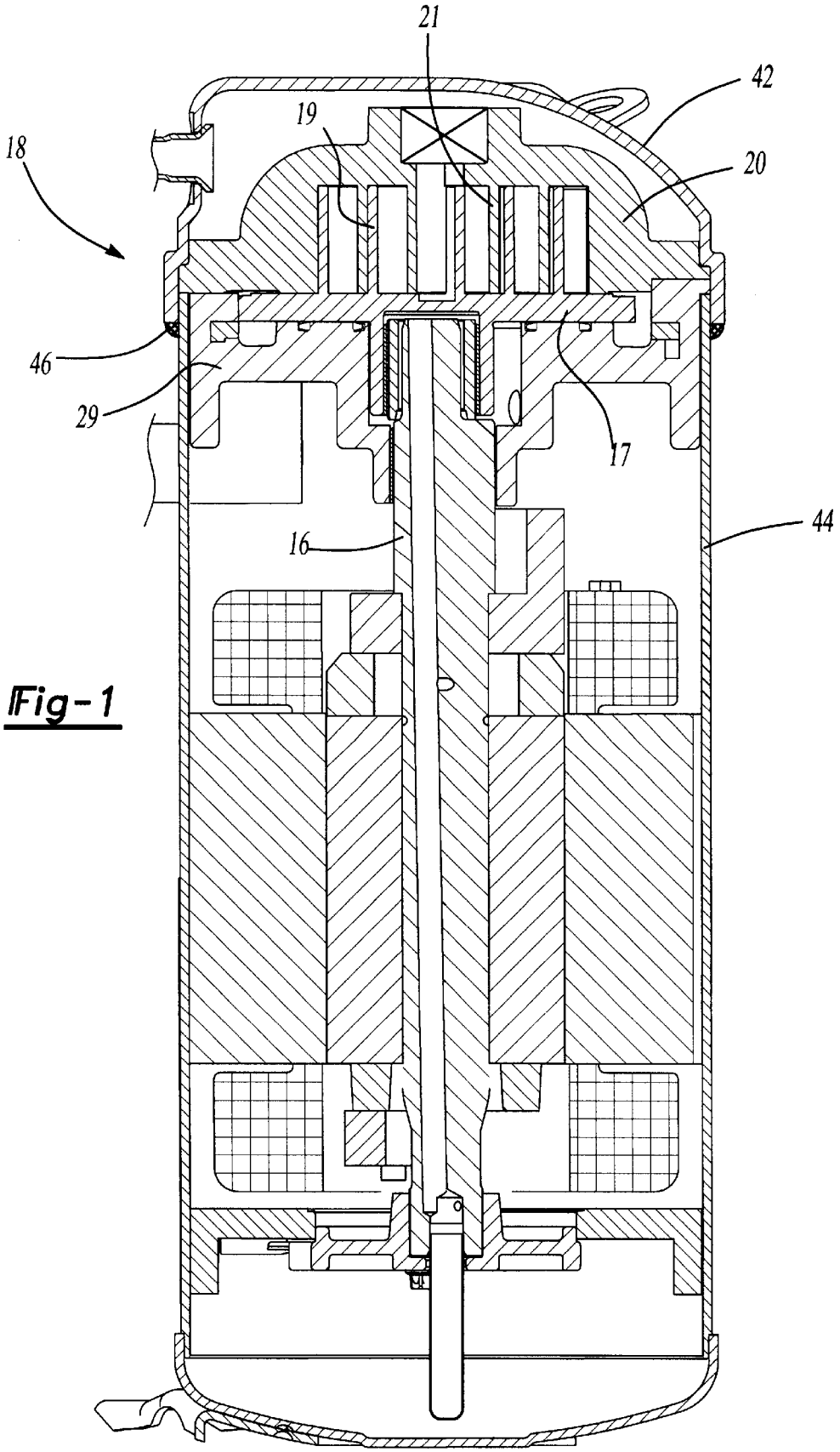
FIG. 1 shows standard scroll compressor structure.

FIG. 1 shows a standard scroll compressor 18. As is known, a non-orbiting scroll 20 includes a scroll wrap 21. The scroll wrap 21 interfits with a scroll wrap 19 from an orbiting scroll 17. The orbiting scroll is caused to orbit by a driveshaft 16. The scroll compressor includes an end cap 42 which is secured to a center shell 44 at a girth weld 46. All of this structure is as known. The present invention improves upon the interrelationship and interconnection between the crankcase 29 and the non-orbiting scroll 20.

Figure 2A:
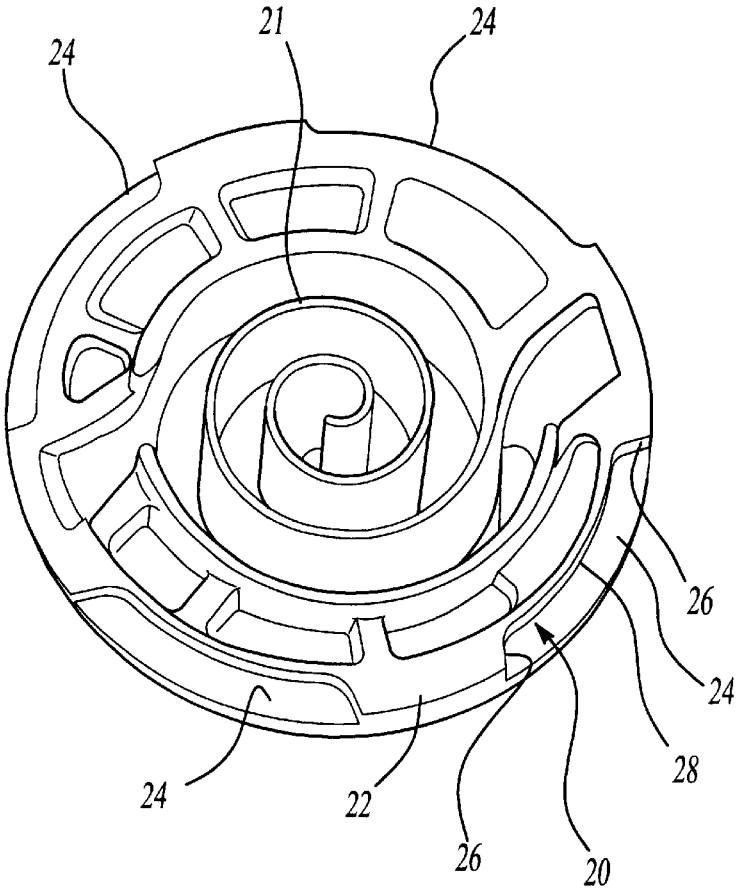
FIG. 2A shows the inventive non-orbiting scroll.

As seen in FIG. 2A, the non-orbiting scroll 20 has tabs 22 which are circumferentially spaced by grooves 24. The grooves 24 have circumferentially spaced ends 26. At least one of the grooves has the circumferential distance between the ends 26 closely dimensioned. Further, the inner radius 28 of the grooves 24 is machined for tight tolerances.

Figure 2B:
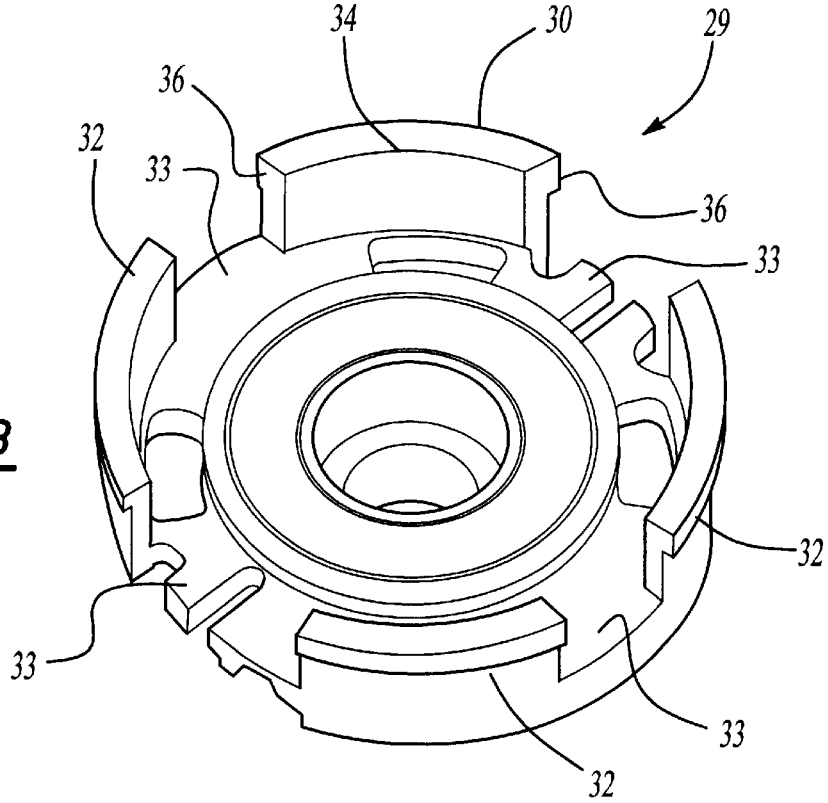
FIG. 2B shows the inventive crankcase.

FIG. 2B shows the inventive crankcase 29. As mentioned above, a plurality of crankcase towers 30 and 32 extend from the crankcase 29. Circumferentially interspaced gaps 33 separate the crankcase towers 30 and 32. The crankcase tower 30 is distinct from the crankcase tower 32 in that circumferential edges 36 are sized to be a close fit, or even an interference fit between the edges 26 of at least one of the grooves 24. Alternatively, one of the tabs 22 could be an interference fit into one of the gaps 33 to provide the same purpose. It is preferred that only one of the towers 30 and grooves 24, or gaps and tabs, have the tight interference fit or close tolerance. The other grooves and towers have a looser fit. However, once the tower 30 is received in the groove 24, the non-orbiting scroll 20 and the crankcase 29 will be properly received at a desired relative rotational position. Further, the inner periphery 34 of the towers 30 is machined to match the outer radius 28 of the grooves 24. In this way, when the towers 30 interfit into the grooves 24 they also position the crankcase and non-orbiting scroll at desired relative positions in a plane perpendicular to the axis of rotation of the shaft 16. The grooves 24 and towers 30 and 32 thus result in a crankcase and non-orbiting scroll which can be quickly and accurately positioned at a desired location relative to each other.

Figure 3:
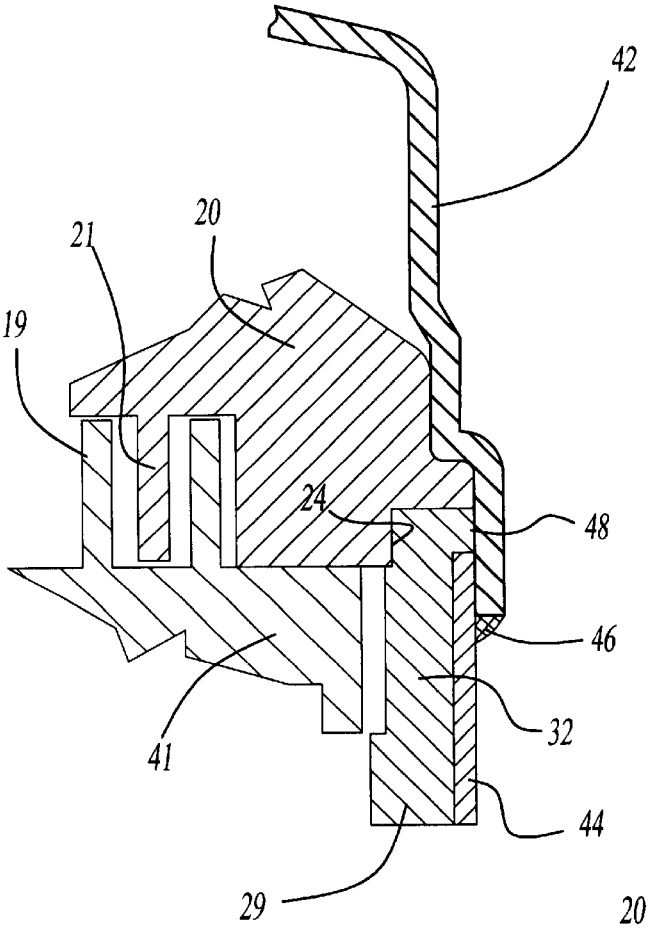
FIG. 3 is a cross-sectional view through one portion of the assembled scroll compressor.
Figure 4:
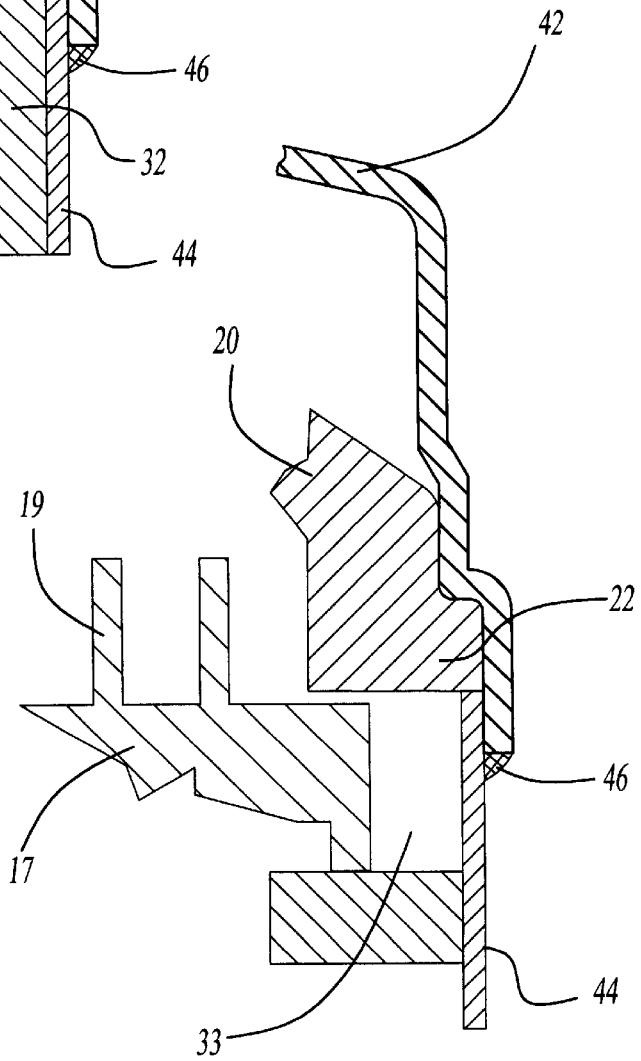
FIG. 4 is a cross-sectional view through a portion spaced circumferentially from the FIG. 3 portion.

Further benefits of this invention can be understood from FIGS. 3 and 4. In FIG. 3, a cross-section is shown through one of the towers 30 or 32. As can be understood, the non-orbiting scroll 20 sits atop the tower 32. The tower 32 has a shoulder 48 extending radially outwardly toward the end cap 42. This shoulder 48 prevents the ingress of weld material from the girth weld 46 from moving axially between the lower edge of the end cap 42 and the center shell 44 and entering the pump chamber.

However, as explained above, in the prior art, the circumferential locations between the crankcase towers were subject to weld ingress, or weld spatter. As is clear from FIG. 4, with the present invention, the tabs 22 extend into the gaps 33 between the towers 30 and 32. Thus, as can be seen in FIG. 4, at circumferential locations between the towers 30 and 32, the tabs 22 move outwardly into the location where the ears 48 are otherwise found. In this way, the ingress of welding material into the housing chamber is blocked.

A preferred embodiment of this invention has been disclosed. However, a worker of ordinary skill in this art would recognize that modifications would come within the scope of this invention. For that reason, the following claims should be studied to determine the true scope and content of this invention.

We claim:

1. A scroll compressor comprising:

a non-orbiting scroll having a base and a generally spiral wrap extending from said base;

an orbiting scroll having a base and a generally spiral wrap extending from said base, said wraps of said non-orbiting and said orbiting scroll interfitting to define compression chambers, and a shaft driving said orbiting scroll to orbit relative to said non-orbiting scroll;

a sealed housing including an end cap mounted outwardly of said non-orbiting scroll, and extending downwardly along a center shell, said center shell and said end cap being connected by a weld joint; and a crankcase connected to said non-orbiting scroll, said crankcase having radially outer towers located at circumferentially spaced locations, said towers being circumferentially spaced by gaps, and said towers extending upwardly to be beyond an uppermost edge of said center shell, and said non-orbiting scroll having tabs extending into circumferential spaces between said towers.

2. A scroll compressor as recited in claim 1, wherein said tabs extend radially outwardly to be closely spaced from an inner peripheral surface of said end cap at a location just axially beyond an axial end of said center shell.

3. A scroll compressor as recited in claim 1, wherein said end cap being welded to center shell, and said interfitting tabs and tower gaps providing a shield for preventing the ingress of weld splatter into the sealed housing.

4. A scroll compressor as recited in claim 1, wherein there are grooves formed in said non-orbiting scroll at circumferential locations between said tabs, and said towers fitting into said grooves.

5. A scroll compressor as recited in claim 4, wherein said grooves have radially outer surfaces which are formed to match radially inner surfaces of said towers such that said grooves and said towers serve to position said crankcase and said non-orbiting scroll at a desired relative location.

6. A scroll compressor as recited in claim 4, wherein structure is provided by at least one of either said grooves and said gaps having a circumferential distance between opposed edges which is sized to be very close in circumferential distance to a circumferential distance between two edges of at least one of either said towers and said tabs for providing a desired rotational position of said crankcase relative to said non-orbiting scroll.

7. A scroll compressor as recited in claim 6, wherein at least one tower provides an interference fit into at least one groove.

8. A scroll compressor are recited in claim 6, wherein at least one tab provides an interference fit into at least one gap.

9. A scroll compressor as recited in claim 6, wherein said grooves have radially outer surfaces which are formed to match radially inner surfaces of said towers such that said grooves and said towers serve to position said crankcase and said non-orbiting scroll at a desired relative location.

10. A scroll compressor comprising:

a non-orbiting scroll having a base and a generally spiral wrap extending from said base;

an orbiting scroll having a base and a generally spiral wrap extending from said base, said wraps of said non-orbiting and said orbiting scroll interfitting to define compression chambers, and a shaft driving said orbiting scroll to orbit relative to said non-orbiting scroll;

a sealed housing including an end cap mounted outwardly of said non-orbiting scroll, and extending downwardly along a center shell, said center shell and said end cap being connected by a weld joint; and a crankcase connected to said non-orbiting scroll, said crankcase having radially outer towers located at circumferentially spaced locations, said towers being circumferentially spaced by gaps, and said non-orbiting scroll having tabs extending into circumferential spaces between said crankcase towers;

grooves formed in said non-orbiting scroll at circumferential locations between said tabs, and said towers fitting into said grooves;

structure being provided by at least one of either said grooves and said gaps having a circumferential distance between opposed edges which is sized to be very close in circumferential distance to a circumferential distance between two edges of at least one of either said towers and said tabs for providing a desired rotational position of said crankcase relative to said non-orbiting scroll; and at least one tower provides an interference fit into at least one groove.

11. A scroll compressor comprising:

a non-orbiting scroll having a base and a generally spiral wrap extending from said base;

an orbiting scroll having a base and a generally spiral wrap extending from said base, said wraps of said non-orbiting and said orbiting scroll interfitting to define compression chambers, and a shaft driving said orbiting scroll to orbit relative to said non-orbiting scroll;

a sealed housing including an end cap mounted outwardly of said non-orbiting scroll, and extending downwardly along a center shell, said center shell and said end cap being connected by a weld joint; and a crankcase connected to said non-orbiting scroll, said crankcase having radially outer towers located at circumferentially spaced locations, said towers being circumferentially spaced by gaps, and said non-orbiting scroll having tabs extending into circumferential spaces between said crankcase towers, and said towers fitting grooves formed in said non-orbiting scroll at circumferential locations between said tabs, and said towers fitting into said grooves wherein said grooves have radially outer surfaces which are formed to match radially inner surfaces of the towers such that said grooves and said towers serve to position said crankcase and said non-orbiting scroll at a desired relative location.

12. A scroll compressor as recited in claim 11, wherein structure is provided by at least one of either said grooves and said gaps having a circumferential distance between opposed edges which is sized to be very close in circumferential distance to a circumferential distance between two edges of at least one of either said towers and said tabs for providing a desired rotational position of said crankcase relative to said non-orbiting scroll.

13. A scroll compressor as recited in claim 12, wherein at least one tab provides an interference fit into at least one gap.

* * * * *